US006659449B2

(12) United States Patent
Kim

(10) Patent No.: US 6,659,449 B2
(45) Date of Patent: Dec. 9, 2003

(54) PICKUP DEVICE FOR USE IN AN IMAGE FORMING APPARATUS

(75) Inventor: Kyung-Hwan Kim, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 132 days.

(21) Appl. No.: 09/962,683

(22) Filed: Sep. 26, 2001

(65) Prior Publication Data

US 2002/0084574 A1 Jul. 4, 2002

(30) Foreign Application Priority Data

Dec. 29, 2000 (KR) ..... 2000-86388

(51) Int. Cl.[7] ..... B65H 43/00
(52) U.S. Cl. ..... 271/117; 271/164
(58) Field of Search ..... 271/117, 164, 271/176, 199, 215; B65H 43/00, 43/04, 7/18, 1/22, 1/26, 3/06

(56) References Cited

U.S. PATENT DOCUMENTS 3,160,411 A * 12/1964 Fiehl ..... 271/4.03
4,872,660 A * 10/1989 Kameyama et al. ..... 271/9.02
4,900,005 A * 2/1990 Blyth et al. ..... 271/127
5,459,548 A * 10/1995 Matsuda et al. ..... 355/72
5,823,529 A * 10/1998 Mandel et al. ..... 271/296
5,842,694 A * 12/1998 Brooks et al. ..... 271/38
6,299,157 B1 * 10/2001 Lim ..... 271/117

FOREIGN PATENT DOCUMENTS

JP 61-60535 * 3/1986 ..... B65H/1/26
JP 5-319678 * 12/1993 ..... B65H/43/06

* cited by examiner

*Primary Examiner*—Donald P. Walsh
*Assistant Examiner*—Kenneth W. Bower
(74) *Attorney, Agent, or Firm*—Robert E. Bushnell, Esq.

(57) ABSTRACT

A pickup device for use in an image forming apparatus has a cassette detachably mounted in a body of the image forming apparatus, and a pickup roller for picking up paper piled on the cassette and feeding it to an image forming engine portion by being moved upward and downward in association with loading/unloading of the cassette. Accordingly, overall size of the image forming apparatus is reduced, while improvement in performance and life span is guaranteed due to minimization of mechanical trouble, obtained by preventing possible collision between the pickup roller and the cassette being loaded, or preventing interference between the pickup roller and the paper. Also, information about paper exhaustion and paper remaining in the cassette is provided in real time.

34 Claims, 6 Drawing Sheets

PICKUP DEVICE FOR USE IN AN IMAGE FORMING APPARATUS

CLAIM OF PRIORITY

This application makes reference to, incorporates the same herein, and claims all benefits accruing under 35 U.S.C. §119 from my application PAPER PICK-UP DEVICE FOR IMAGE FORMING APPARATUS filed with the Korean Industrial Property Office on Dec. 29, 2000 and there duly assigned Serial No. 86388/2000.

BACKGROUND OF THE INVENTION

1. Technical Field

The present invention relates to a pickup device for use in an image forming apparatus, such as a printer, a copier, or the like, for picking up paper from a cassette and feeding the picked up paper to an image forming engine portion. More particularly, the invention relates to a pickup device for use in an image forming apparatus having a pickup unit for driving a pickup roller upward and downward in association with loading/unloading of the cassette.

2. Related Art

Generally, an image forming apparatus, such as a laser printer, a copier or the like, has a pickup device for sequentially picking up paper which is stacked or piled on a cassette detachably mounted in a main body of the image forming apparatus. The picked up paper is fed to an image forming engine portion.

A conventional pickup device of an image forming apparatus includes a hopper plate formed on the bottom of the cassette which is removable from the body of the image forming apparatus. The hopper plate is biased upward by a spring. Plural sheets of paper are loaded on the hopper plate in such a manner that an uppermost sheet of paper is in close contact elastically with a pickup roller. As a result of a rotational driving force of the pickup roller, the uppermost sheet of paper is fed to the image forming engine portion.

Accordingly, in the conventional image forming apparatus as described above, the cassette is usually loaded in or unloaded from the image forming apparatus in a direction corresponding to the direction in which the paper is fed and discharged. Therefore, front and rear ends of the image forming apparatus have to be large enough to permit loading or unloading of a cassette for accommodating large-sized paper.

To solve the above-described problem, the cassette can be loaded or unloaded through a side of the body of the image forming apparatus. However, in this case, jamming of the uppermost sheet of paper often occurs while mounting the cassette in the body of the image forming apparatus.

SUMMARY OF THE INVENTION

The present invention has been developed in order to overcome the above-mentioned problems of the related art. Accordingly, it is an object of the present invention to provide a pickup device for use in an image forming apparatus capable of picking up and feeding paper through upward and downward driving of a pickup roller in association with loading/unloading of a paper cassette.

Another object of the present invention is to provide a pickup device for reducing the volumetric appearance of the image forming apparatus by feeding the paper in a direction perpendicular to a paper cassette loading or unloading direction.

Yet another object of the present invention is to provide a pickup device capable of detecting and displaying information about the amount of remaining paper or lack of paper while picking up and feeding the paper from the paper cassette.

In order to accomplish the above objects, the invention provides a pickup unit for use in an image forming apparatus for picking up a sheet of paper from a stack or pile of paper loaded in a cassette which is detachably mounted in a body of the image forming apparatus. The paper is provided to an image forming engine portion. The pickup unit includes: a pickup roller for feeding an uppermost sheet of paper from the pile of paper on the cassette in a predetermined direction by contacting it, and thus transmitting a rotational driving force thereto; loading/unloading means for moving the pickup roller upward and downward in association with the loading/unloading of the cassette; and driving means for transmitting the rotational driving force to the pickup roller, thereby feeding paper from the cassette sequentially.

According to one aspect of the present invention, the loading/unloading means includes: a cam projection protruding from a leading end of the cassette; a supporting frame disposed on a cassette mounting portion of the body; a cam lever formed on the supporting frame and elastically biased in a predetermined direction so as to be interfered with, and thus pivoted by, the cam projection during the loading/unloading of the cassette; a pickup bracket disposed on the supporting frame, the pickup bracket having a free end which is moved upward and downward while rotatably supporting the pickup roller; an elastic body for elastically biasing the free end of the pickup bracket toward the cassette; and a locking arm connected with the cam lever so as to be operated in association with the cam lever for selectively locking/unlocking the pickup bracket.

According to another aspect of the present invention, the loading/unloading means includes locking/unlocking means for selectively restricting, and thus setting, the pickup bracket to be able to move upward and downward by manipulation of a main controller which is formed on the body irrespective of the loading/unloading of the cassette. The locking/unlocking means includes: a solenoid unit disposed on the supporting frame and controlled by the main controller; a rotary shaft disposed on the supporting frame and pivoted according to operation of the solenoid unit; and a hook member disposed on one end of the rotary shaft for selectively restricting, and thus locking/unlocking, the pickup bracket according to a pivoting movement of the rotary shaft.

According to yet another aspect of the present invention, the pickup unit includes paper remainder detecting means for detecting the remainder of the stack of paper, and for displaying detected information. The paper remainder detecting means includes: a paper contact lever moved upward and downward by the loading/unloading means to contact with the stack of paper on the cassette; a link arm pivoted in association with the paper contact lever, the link arm having a long hole formed in a body thereof; a guide portion disposed on the supporting frame and in parallel relation with respect to a side of the link arm, the guide portion having a guide slit overlapping a travel path of the long hole during a pivoting of the link arm; a slide pin restrictively connected in such a manner that it is passed through the long hole and the guide slit, said slide pin being linearly slid according to the pivoting of the paper contact lever and the link arm; and sensing means for detecting and outputting information about a displacement location of the slide pin in the form of a signal.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE PREFERRED EMBODIMENT

This invention will be described in further detail by way of example with reference to the attached drawings.

Figure 1:
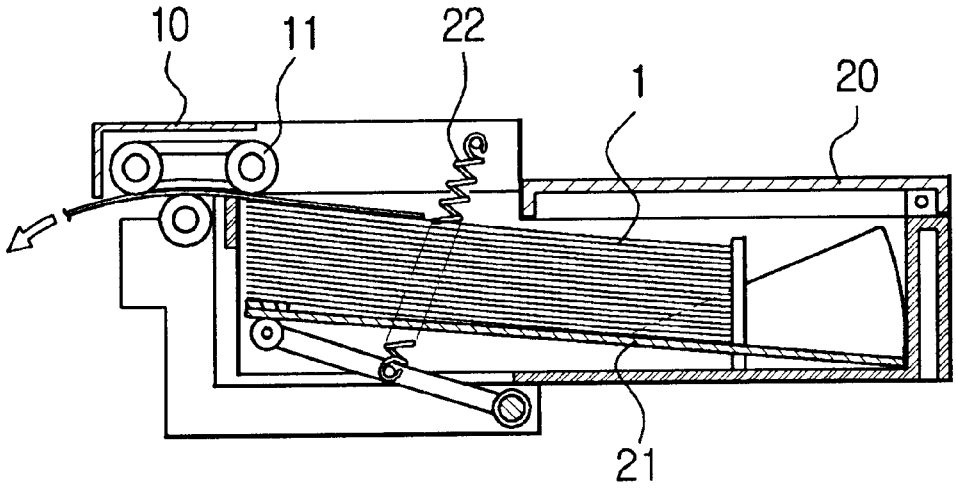
FIG. 1 is a schematic sectional view showing a pickup device employed in an image forming apparatus.

FIG. 1 schematically shows a pickup device of an image forming apparatus, including a hopper plate 21 formed on the bottom of the cassette 20, while is removable from a body 10 of the image forming apparatus. As shown, the hopper plate 21 is biased upward by a spring 22. Plural sheets of paper 1 are loaded on the hopper plate 21 in such a manner that an uppermost sheet of the paper 1 is in close contact elastically with a pickup roller 11. As a result of a rotational driving force of the pickup roller 11, the uppermost sheet of paper 1 is fed to the image forming engine portion (not shown).

Accordingly, in the image forming apparatus as described above, the cassette 20 is usually loaded in or unloaded from the image forming apparatus in a direction corresponding to the direction in which the paper is fed and discharged. Therefore, front and rear ends of the image forming apparatus have to be large enough to permit loading or unloading of a cassette for accommodating large-sized paper.

To solve the above-described problem, the cassette 20 can be loaded or unloaded through a side of the body of the image forming apparatus. However, jamming of the uppermost sheet of paper often occurs while mounting the cassette 20 in the body of the image forming apparatus.

Figure 2:
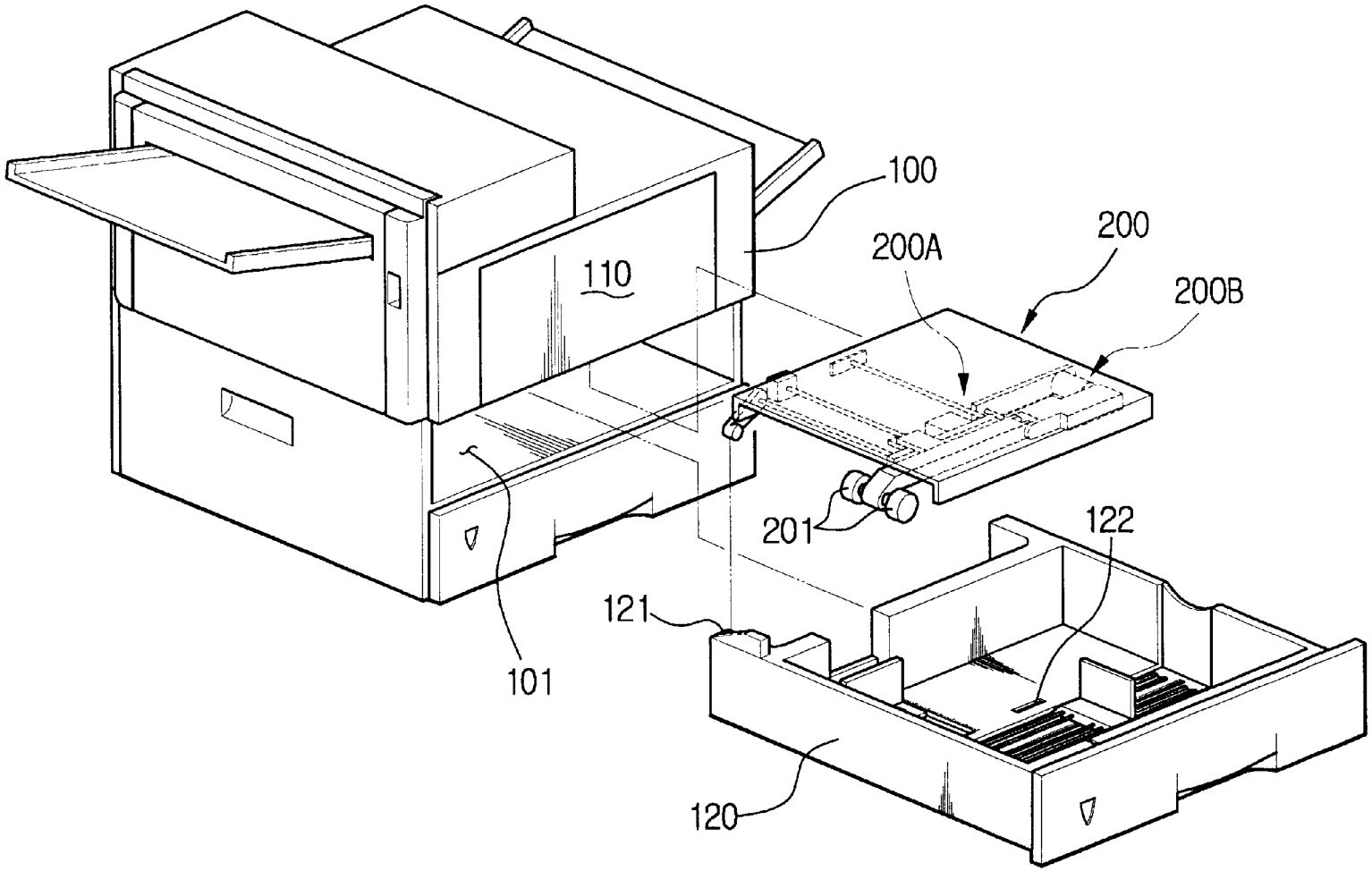
FIG. 2 is a schematic perspective view showing the main portion (i.e., the pickup device) according to the present invention.

FIG. 2 is a schematic perspective view showing the main portion (i.e., the pickup device) according to the present invention. Referring to FIG. 2, the pickup device of the image forming apparatus according to the present invention includes a pickup unit 200 mounted in a cassette mounting portion 101 of an image forming apparatus body 100 for sequentially picking up and feeding the paper from the cassette 120 to an image forming engine portion 110.

According to the present invention, the pickup unit 200 includes a pickup roller 201 for feeding the paper in a direction perpendicular to a loading/unloading direction of cassette 120, a loading/unloading portion 200A for driving the pickup roller 201 upward and downward with respect to an upper portion of the paper in association with the loading/unloading of the cassette 120, and a driving portion 200B for transmitting a rotational driving force to the pickup roller 201 for sequentially feeding the paper from the cassette 120.

According to the pickup device of the image forming apparatus of the present invention, the pickup roller 201 is mounted in a direction perpendicular to the cassette loading/unloading direction. As shown in FIG. 2, the cassette 120 is loaded or unloaded in a direction perpendicular to the direction in which the paper is picked up and fed with respect to the image forming apparatus body 100.

Figure 3:
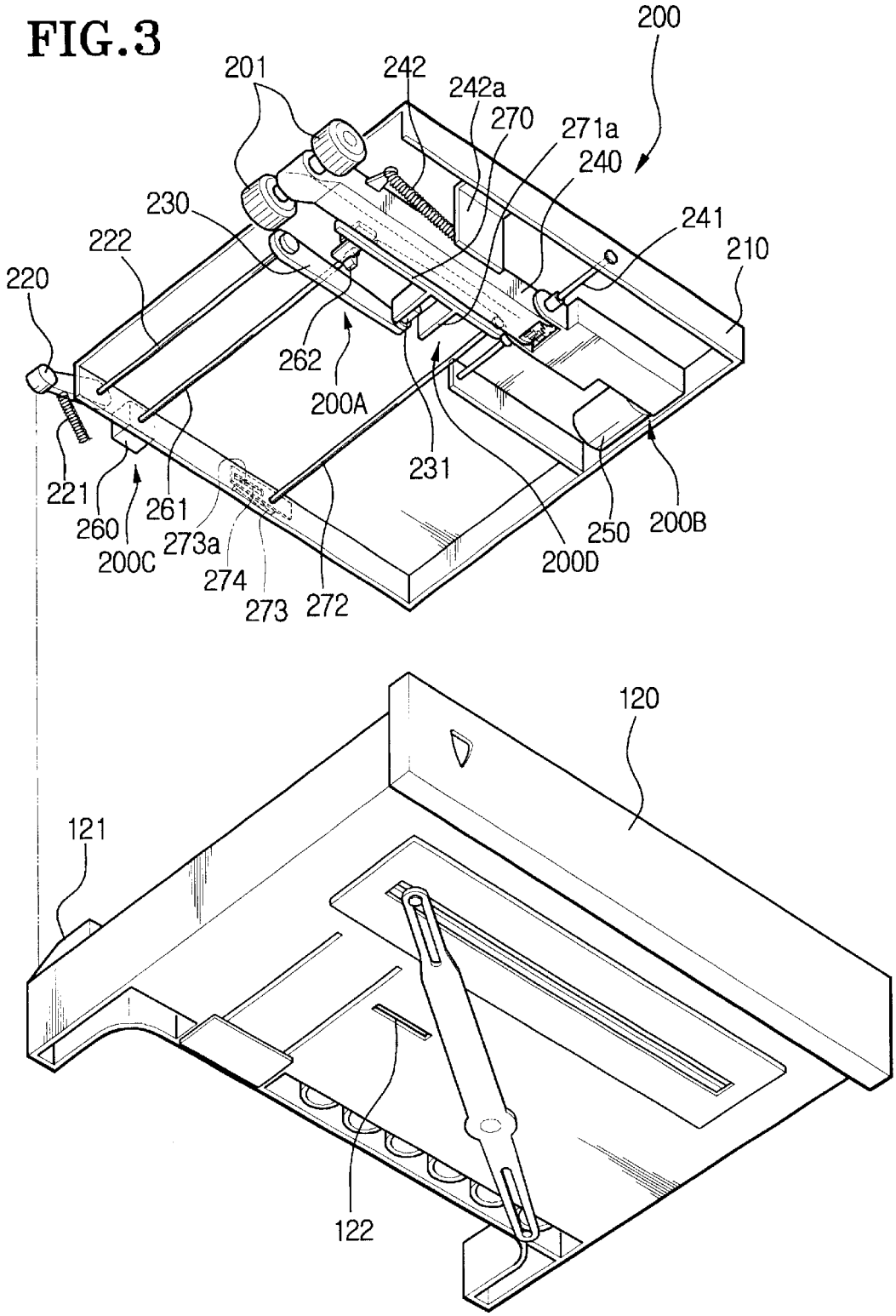
FIG. 3 is a perspective view showing in detail the structure of the pickup device of an image forming apparatus according to the present invention.
Figure 4:
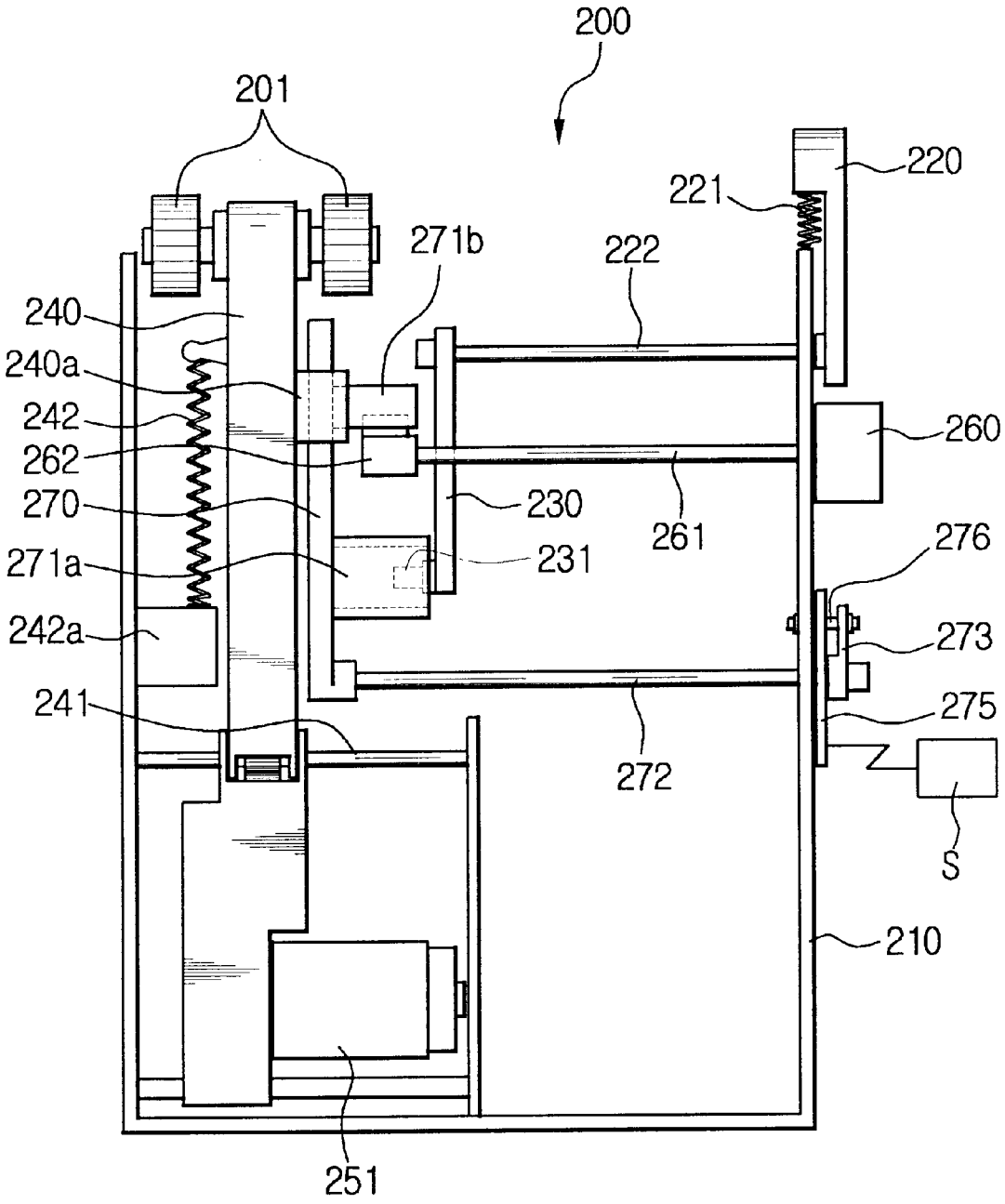
FIG. 4 is a plan view schematically showing the pickup unit of FIGS. 2 and 3.

FIG. 3 is a perspective view showing in detail the structure of the pickup device of an image forming apparatus according to the present invention, while FIG. 4 is a plan view schematically showing the pickup unit of FIGS. 2 and 3. Referring to FIGS. 3 and 4, the loading/unloading portion 200A includes: a cam projection 121 formed on a leading end of the cassette 120, and having a cam curve formed thereon; a supporting frame 210 mounted on the cassette mounting portion 101 of the body 100; a cam lever 220 mounted on the supporting frame 210 for being interfered with, and pivoted by, the cam projection 121 during loading/unloading of the cassette; a locking arm 230 for pivoting in association with the cam lever 220 in a direction opposite to that of the cam lever 220; and a pickup bracket 240 pivotally mounted on a supporting shaft 241, which is mounted on the supporting frame 210, for being restricted and moved upward and downward by the locking arm 230.

The cam lever 220 is elastically biased downward toward the cassette 120 by a spring 221 disposed on the body 100, and cam lever 220 is connected to the locking arm 230 via a rotational shaft 222 that is used for the rotation in unison of the cam lever 220 and the locking arm 230.

The locking arm 230 restricts the movement of the pickup bracket 240 to the upward and downward direction as a locking pin 231, formed on a free end of the locking arm 230, directly and indirectly interferes with the pickup bracket 240 during a pivoting of the locking arm 230.

The locking arm 230 indirectly restricts the movement of the pickup bracket 240 to the upward and downward direction by being operated in association with a hook member 262 of a locking/unlocking means 200C and/or a paper contact lever 270 of a paper remainder detecting means 200D. The locking/unlocking means 200C and the paper remainder detecting means 200D will be described later.

Although it is not shown in the drawings, the locking pin 231 of the locking arm 230 may directly restrict movement of the pickup bracket 240 to the upward and downward direction.

While rotatably supporting the pickup roller 201, the free end of the pickup bracket 240 is elastically biased downward to the cassette 120 by the spring 242, which is disposed on a supporting portion 242*a* of the supporting frame 210.

Since the pickup roller 201 feeds the uppermost paper on the cassette 120 under proper pressure, slip occurrence is prevented.

Figure 5:
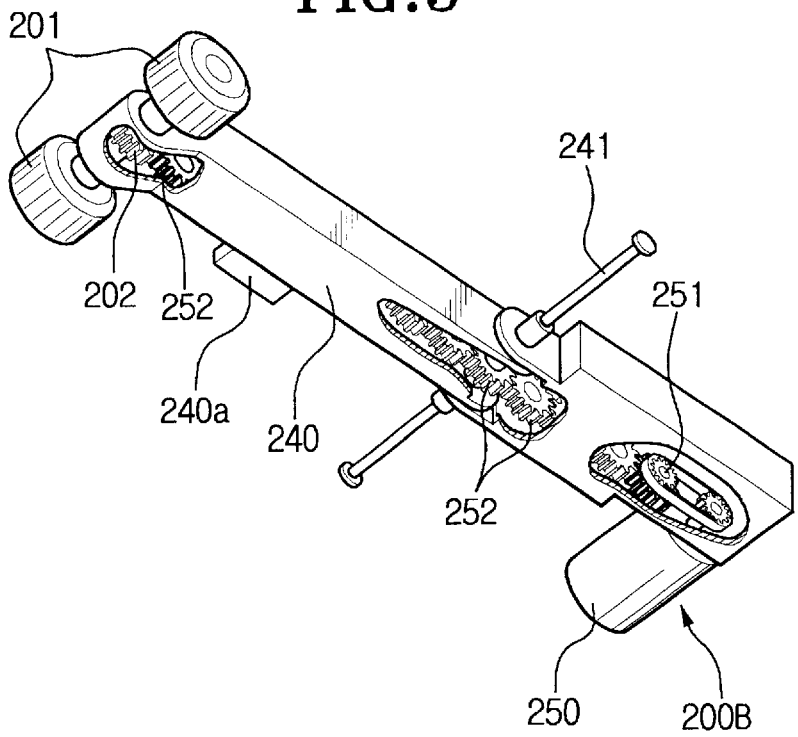
FIG. 5 is a partially cutaway perspective view schematically showing a pickup roller driving portion formed in the pickup device of the image forming apparatus according to a preferred embodiment of the present invention.

FIG. 5 is a partially cutaway perspective view schematically showing a pickup roller driving portion formed in the pickup device of the image forming apparatus according to a preferred embodiment of the present invention. According to the present invention, as shown in FIG. 5, the driving portion or means 200B of the pickup roller 201 includes a driving motor 250 supported on the supporting frame 210, and a power transmitting means disposed on the pickup bracket 240 for transmitting the rotational driving force of the driving motor 250 to the pickup roller 201.

According to one aspect of the present invention, the power transmitting means includes a belt pulley 251 connected to an output side of the driving motor 250, a driven gear 202 disposed on a rotary axle of the pickup roller 201, and a plurality of connecting gears 252 disposed in the pickup bracket 240 for connection to the belt pulley 251.

Meanwhile, in the pickup device of the image forming apparatus according to the present invention, pickup unit 200 (referring back to FIG. 3) includes the locking/unlocking means 200C for selectively restricting and movably setting the pickup bracket 240 upward and downward by the manipulation of a main controller (not shown), formed in the body 100, irrespective of the loading/unloading of the cassette 120.

According to one aspect of the present invention, the locking/unlocking means 200C includes a solenoid driving unit 260 disposed on the supporting frame 210 so as to be controlled by the key input manipulation of the main controller (not shown), a rotary shaft 261 disposed on the supporting frame 210 so as to be rotated by the operation of the solenoid driving unit 260, and a hook member 262 disposed on one end of the rotary shaft 261 for directly or indirectly restricting and thus locking/unlocking, the pickup bracket 240 according to the rotation of the rotary shaft 261.

In association with the paper contact lever 270 of the paper remainder detecting means 200D, the hook member 262 indirectly interferes with, and thus restricts the movement of, the pickup bracket 240 to the upward and downward directions.

In the pickup device of the image forming apparatus according to the present invention, a pickup unit 200 includes the paper remainder detecting means 200D for detecting and indicating information about lack of paper and/or remainder of paper stacked on the cassette 120.

Figure 6:
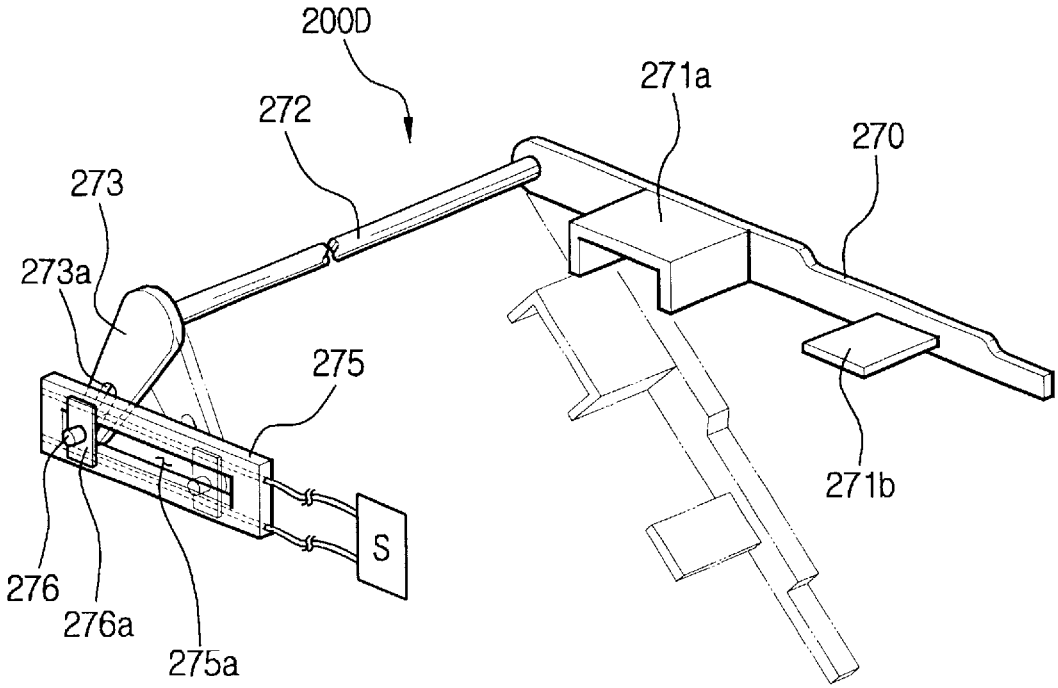
FIG. 6 is a perspective view schematically showing the main portion (i.e., a paper termination/remainder detecting portion) formed in the pickup device of the image forming apparatus according to the present invention.
Figure 7:
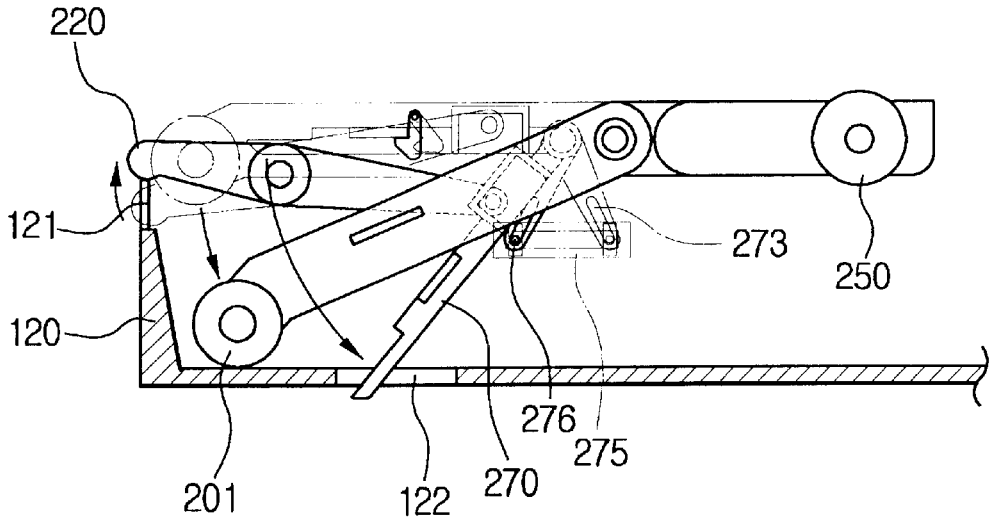
FIG. 7 is a schematic sectional view showing the paper termination/remainder detecting portion of FIG. 6, and is used to explain the operation thereof.
Figure 8:
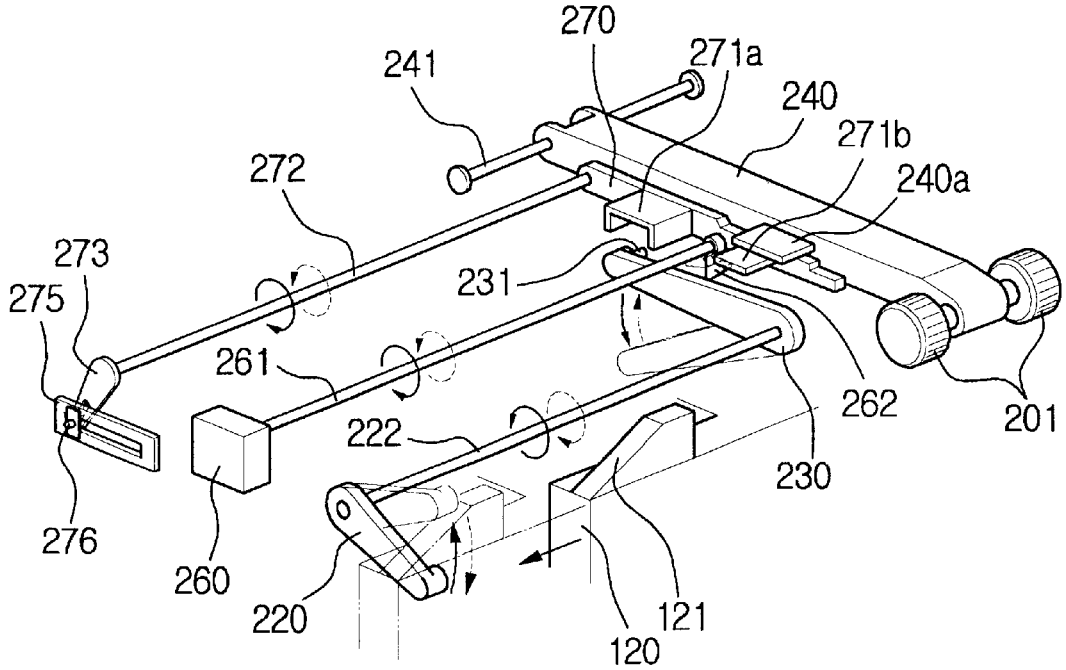
FIG. 8 is a partially cutaway perspective view schematically showing the main portion (i.e., the pickup device) of the image forming apparatus according to the present invention, and is used to explain the operation thereof.

FIG. 6 is a perspective view schematically showing the main portion (i.e., a paper termination/remainder detecting portion) formed in the pickup device of the image forming apparatus according to the present invention, FIG. 7 is a schematic sectional view showing the paper termination/remainder detecting portion of FIG. 6, used to explain the operation thereof, and FIG. 8 is a partially cutaway perspective view schematically showing the main portion (i.e., the pickup device) of the image forming apparatus according to the present invention used to explain the operation thereof.

Referring to FIG. 6, the paper remainder detecting means 200D includes paper contact lever 270 rotatably disposed on the rotary shaft 272 on the supporting frame 210 in a parallel relation with respect to one side of the pickup bracket 240, a link arm 273 rotated in association with the paper contact lever 270, a guide portion 275 disposed on the supporting frame 210 in a parallel relation with respect to the link arm 273, and a slide pin 276 movably passed through the link arm 273 and the guide portion 275.

The paper contact lever 270 includes a locking elevation 271*a* and a locking segment 271*b* respectively protruding from the body thereof. Accordingly, as the locking elevation 271*a* and the locking segment 271*b* are respectively restricted by the hook member 262 of the locking/unlocking means 200C, movement of the paper contact lever 270 is restricted to the upward and downward directions.

The link arm 273 has a long hole 273*a* formed lengthwise on the free end thereof, while the guide portion 275 has a guide slit 275*a* formed lengthwise on the body thereof and overlapping a traveling path of the long hole 273*a* during a pivoting of the link arm 273.

Accordingly, in the process of being inserted through the long hole 273*a* and the guide slit 275*a*, the slide pin 276 is connected to the connecting portion 276*a* so as to be displaced by being linearly moved along the guide slit 275*a* during the pivoting of the link arm 273.

In this case, information as to the displacement location of the slide pin 276 is detected by a sensing means S in the form of a signal which is output to the main controller (not shown). Accordingly, the information about paper remaining in the cassette 120 is displayed.

The sensing means S may have a structure in which an outline of the guide slit 275*a* of the guide potion 275 is formed as an electric conductor electrically connected to a power input/output lead line. The sensing means S may also have a structure in which a conductor contacts the end of the slide pin 276, thereby detecting electrical resistance or an electric current value variably output according to the displacement location of the slide pin 276, and converting the detected value into a corresponding electrical signal. Furthermore, the sensing means S may have a structure in which one of various types of sensors, such as a photo-sensor, is employed to detect the displacement location of the slide pin 276, and to output the detected result in the form of a corresponding electric signal.

Referring to FIGS. 3 thru 6, while the paper contact lever 270 is moved downwardly by the sequential restriction and release of the locking pin 231 and the hook member 262, the paper contact lever 270 is upwardly moved only by the restriction of the locking pin 231 during the pivoting of the locking arm 230.

The pickup bracket 240 has a projecting portion 240*a* protruding from the body thereof so as to be mounted on the body of the paper contact lever 270. Accordingly, the pickup bracket 240 is moved upward and downward in association with the paper contact lever 270.

The pickup device of the image forming apparatus according to the present invention includes a paper termination detecting means for detecting presence of the paper on the cassette 120. In other words, the paper termination detecting means detects whether or not there is a 'no paper' state.

The paper termination detecting means includes a slit 122 (see FIGS. 2, 3, and 7) formed in the bottom of cassette 120 for permitting the leading end of the paper contact lever 270 to pass therethrough.

Accordingly, as shown in FIG. 7, when the leading end of the paper contact lever 270 passes downward through the slit 122, the slide pin 276 detects the 'no paper' state according to the signal output as the slide pin 276 is moved to a corresponding location.

In another embodiment, information about the 'no paper' state can also be displayed by forming a separate sensor, such as a photo-sensor (not shown), around the slit 122 for detecting whether or not the leading end of the slide pin 276 has passed through the slit 122.

The operation for picking up paper from the cassette 120 with the pickup device of the image forming apparatus, constructed as described above according to the present invention, will now be described in greater detail below with reference to the accompanying drawings.

As shown in FIGS. 2, 3 and 8, when the cassette 120 holding paper is mounted on the cassette mount portion 110, the cam lever 220 interferes with the cam projection 121 formed on the leading end of the cassette 120, and is thus pivoted upward while the locking arm 230 is simultaneously pivoted downward.

Accordingly, the locking elevation 271*a* of the paper contact lever 270 is released by the locking pin 231 of the locking arm 240, while the locking segment 271*b* of the paper contact lever 270 is continuously restricted by the hook member 262 of the locking/unlocking means 200C. As a result, the paper contact lever 270 is maintained in an initial setting state.

In such a situation, as the user manipulates the control panel and thus inputs a print command to the main controller of the image forming apparatus, the main controller (not shown) operates the solenoid unit 260 of the locking/unlocking means 200C, and thus pivots the rotary shaft 261 to a predetermined angle.

Accordingly, the hook member 262 is rotated in association with the rotary shaft 261, and the paper contact lever 270 is released from the locking segment 271*b*. As the paper contact lever 270 is released from the locking segment 271*b*, the free end of the paper contact lever 270 falls free, and accordingly, the paper contact lever 270 is displaced downward into contact with an uppermost paper of the stack of paper on the cassette 120.

Meanwhile, due to the downward displacement of the paper contact lever 270, the paper remainder detecting means 200D is operated. That is, during the downward displacement of the paper contact lever 270, the link arm 273 is accordingly pivoted, and the slide pin 276 located in the long hole 273*a* is slid linearly along the guide slit 275*a* of the guide portion 275.

The downward displacement distance of the paper contact lever 270 is determined according to the height of the stack of paper on the cassette 120, while the displacement location of the slide pin 276 is also determined according to such determined downward displacement distance of the paper contact lever 270.

Since the information about the displacement location or displacement distance of the slide pin 276 can be detected by the sensing means S connected thereto, and can be output to the main controller, the information about the paper remaining in the cassette 120 can be displayed.

To implement a signal detecting and outputting method of the sensing means S, the outline of the guide slit 275*a* of the guide portion 275 can be formed of a conductor connected to the lead line of the power input/output. In another embodiment, the end of the slide pin 276 may be brought into contact with the conductor for detecting electrical resistance or an electric current value variably output according to the displacement location of the slide pin 276, and for converting such detected value into an electrical signal.

Further, since the paper contact lever 270 is gradually de-elevated by a minute distance according to the gradual decrease in the stack of paper in the cassette 120, the change in the displacement distance can be reflected through the slide pin 276, while the information about the amount of paper remaining in the cassette 120 is provided in real time.

Here, in the event of complete exhaustion of the paper in the cassette 120, the leading end of the paper contact lever 270 passes through the slit 122 formed in the bottom of the cassette 120. Based on such a state of the paper contact lever 270, the 'no paper' state can be detected and displayed. The information can be detected by using the above-described sensing means S, or by using another sensor, such as a photo-sensor, that can detect whether or not the leading end of the paper contact lever 270 has passed through the slit 122.

As described above, as the paper contact lever 270 is displaced downward, the pickup bracket 240 is released from the locking segment 271*b*, and is thus downwardly displaced.

The pickup bracket 240 is elastically biased downward by the tension of the spring 242 disposed on the leading end thereof, and accordingly, the pickup roller 201 contacts the uppermost paper in the pile of paper on the cassette 120 under a predetermined tension.

When the paper contact lever 270 and the pickup bracket 240 are downwardly displaced, by the sequential controlling of the main controller (not shown), the pickup roller driving means 200B is operated. Accordingly, the rotational driving force of the driving motor 250 is transmitted to the pickup roller 201 through the power transmitting means, such as the belt pulley 251 and the plurality of connecting gears 252, and the pickup roller 201 sequentially feeds the paper stacked in the cassette 120 to the image forming engine portion 110.

Meanwhile, according to the pickup device of the image forming apparatus according to the present invention, in the event of complete paper exhaustion, the cassette 120 is removed from the image forming apparatus body so as to be loaded with a new stack of paper. In such a case, the cam lever 220 is released by the cam projection 121 of the cassette 120, and pivoted downward by the tension of the spring 221, while the locking arm 230 is simultaneously pivoted upward accordingly.

Accordingly, the locking pin 231 of the locking arm 230 restricts, and thus lifts, the locking elevation 271*a* of the paper contact lever 270, while the projecting portion 240*a* formed at one end of the pickup bracket 240, and mounted on the locking segment 271*b* of the paper contact lever 270, is restricted and simultaneously lifted.

Accordingly, in the pickup device of the image forming apparatus according to the present invention, since the pickup roller 201 is elevated or de-elevated in association with the loading/unloading of the cassette 120, possible collision of the cassette 120 with the pickup roller 201, or interference of the pickup roller 201 with the paper, can be prevented.

According to the pickup device of the image forming apparatus according to the present invention, the following effects can be achieved.

First, the overall size of the image forming apparatus can be reduced. In other words, since the pickup roller 201 is moved upward and downward in association with the loading/unloading of the cassette 120 to prevent interference between the pickup roller 201 and the uppermost paper during the loading of the cassette 120, the cassette 120 can be loaded and unloaded with respect to the body of the image forming apparatus in a perpendicular direction relative to the direction in which the paper is fed and discharged. As a result, the image forming apparatus according to the present invention can be kept relatively compact compared to a method in which the cassette is loaded and unloaded in the same direction as the direction in which paper feeding and discharge take place.

Second, since the pickup roller 201 is downwardly displaced according to the loading/unloading of the cassette and the input of the print command, the possible collision between the cassette 120 and the pickup roller 201, and interference between the pickup roller 201 and the paper, can be prevented. Accordingly, the occurrence of mechanical problems can be minimized, and improved performance and life span can be expected.

Finally, since information about the exhaustion of paper and/or the amount of paper remaining in the cassette 120 can be detected and provided in real time upon loading the cassette 120 or performing the printing process, the user is provided with convenience in use.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A pickup device for picking up a sheet of paper from a stack of paper loaded in a cassette which is detachably mounted in a body of an image forming apparatus, and for feeding the picked up paper to an image forming engine portion, said pickup device comprising:

a pickup roller for feeding an uppermost sheet of paper of the stack of paper in the cassette in a predetermined direction by contacting, and thus transmitting a rotational driving force to, the uppermost sheet of paper;

loading/unloading means for moving the pickup roller upward and downward in association with loading and unloading of the cassette; and driving means for transmitting the rotational driving force to the pickup roller, thereby enabling the pickup roller to feed the paper from the cassette sequentially.

2. The pickup device of claim 1, wherein the loading/unloading means comprises:

a cam projection protruding from a leading end of the cassette;

a supporting frame disposed on a cassette mount portion of the body;

a cam lever formed on the supporting frame and elastically biased in a predetermined direction for being interfered with, and thus pivoted by, the cam projection during the loading and unloading of the cassette;

a pickup bracket disposed on the supporting frame and having a free end which moves upward and downward while rotatably supporting the pickup roller;

an elastic body for elastically biasing the free end of the pickup bracket toward the cassette; and a locking arm connected to the cam lever so as to be operated in association with the cam lever, the locking arm selectively locking and unlocking the pickup bracket.

3. The pickup device of claim 2, further comprising locking/unlocking means for selectively restricting movement of the pickup bracket so that the pickup bracket moves upward and downward by manipulation of a main controller, which is formed on the body of the image forming apparatus, irrespective of the loading and unloading of the cassette.

4. The pickup device of claim 3, wherein the locking/unlocking means comprises:

a solenoid unit disposed on the supporting frame and controlled by the main controller;

a rotary shaft disposed on the supporting frame and pivoted according to operation of the solenoid unit; and a hook member disposed on one end of the rotary shaft for selectively restricting movement of the pickup bracket according to pivoting movement of the rotary shaft.

5. The pickup device of claim 2, wherein the driving means comprises:

a driving motor disposed on the supporting frame; and a power transmitting unit for transmitting a rotational driving force from the driving motor to the pickup roller.

6. The pickup device of claim 5, wherein the power transmitting unit comprises a belt pulley disposed on the pickup bracket, and connected to an output shaft of the driving motor and to a rotary shaft of the pickup roller.

7. The pickup device ofclaim 5, wherein the pickup roller has a rotary shaft on which a driving gear is disposed, and wherein the power transmitting unit comprises:

a belt pulley disposed on the pickup bracket and connected to an output shaft of the driving motor; and a plurality of connecting gears disposed on the pickup bracket for connecting the driving gear disposed on the rotary shaft of the pickup roller with the belt pulley.

8. The pickup device of claim 1, wherein the driving means comprises:

a driving motor; and a power transmitting unit for transmitting a rotational driving force from the driving motor to the pickup roller.

9. The pickup device of claim 8, wherein the power transmitting unit comprises a belt pulley disposed on the pickup bracket, and connected to an output shaft of the driving motor and a rotary shaft of the pickup roller.

10. The pickup device of claim 8, wherein the pickup roller has a rotary shaft on which a driving gear is disposed, and wherein the power transmitting unit comprises:

a belt pulley disposed on the pickup bracket and connected to an output shaft of the driving motor; and a plurality of connecting gears disposed on the pickup bracket for connecting the driving gear disposed on the rotary shaft of the pickup roller with the belt pulley.

11. The pickup device of claim 1, wherein the image forming apparatus further comprises paper remainder detecting means for detecting a remainder of the stack of paper, and for displaying detected remainder information.

12. The pickup device of claim 11, wherein the paper remainder detecting means comprises:

a paper contact lever which is moved upward and downward by the loading/unloading means to contact the stack of paper in the cassette;

a link arm which pivots in association with the paper contact lever, the link arm having a long hole formed in a body thereof;

a guide portion disposed in a parallel relation with respect to a side of the link arm, the guide portion having a guide slit overlapping a travel path of the long hole during a pivoting of the link arm;

a slide pin restrictively connected to said link arm and said guide portion by passing through the long hole and the guide slit, respectively, for linearly sliding according to the pivoting of the paper contact lever and the link arm; and a sensing unit for detecting a displacement location of the slide pin and for outputting displacement information in the form of an electric signal.

13. The pickup device of claim 12, wherein the paper remainder detecting means detects information about presence and absence of the paper in the cassette according to whether or not a free end of the paper contact lever passes through a slit formed in a bottom of the cassette.

14. The pickup device of claim 1, wherein the pickup roller feeds the uppermost sheet of paper in a direction perpendicular to a direction in which the cassette is loaded and unloaded.

15. A pickup device for picking up a sheet of paper from a stack of parer loaded in a cassette which is detachably mounted in a body of an image forming apparatus, and for feeding the picked up paper to an image forming engine portion, said pickup device comprising:

a pickup roller for feeding an uppermost sheet of paper of the stack of paper in the cassette in a predetermined direction by contacting, and thus transmitting a rotational driving force to, the uppermost sheet of paper;

loading/unloading means for moving the pickup roller upward and downward in association with loading and unloading of the cassette; and driving means for transmitting the rotational driving force to the pickup roller, thereby enabling the pickup roller to feed the paper from the cassette sequentially;

wherein the image forming apparatus further comprises paper remainder detecting means for detecting a remainder of the stack of paper, and for displaying detected remainder information; and wherein the paper remainder detecting means comprises:

a paper contact lever which is moved upward and downward by the loading/unloading means to contact the stack of paper in the cassette; and wherein the paper remainder detecting means detects information about presence and absence of the paper in the cassette according to whether or not a free end of the paper contact lever passes through a slit formed in a bottom of the cassette.

16. A pickup device for picking up a sheet of paper from a stack of paper loaded in a cassette which is detachably mounted in a body of an image forming apparatus, and for feeding the picked up paper to an image forming engine portion, said pickup device comprising:

a pickup roller for feeding an uppermost sheet of paper of the stack of paper in the cassette in a predetermined direction by contacting, and thus transmitting a rotational driving force to, the uppermost sheet of paper;

loading/unloading means for moving the pickup roller upward and downward in association with loading and unloading of the cassette; and driving means for transmitting the rotational driving force to the pickup roller, thereby enabling the pickup roller to feed the paper from the cassette sequentially wherein said loading/unloading means comprises a pickup bracket having a free end which moves upward and downward while rotatably supporting the pickup roller;

said pickup device further comprising locking/unlocking means for selectively restricting movement of the pickup bracket so that the pickup bracket moves upward and downward by manipulation of a main controller, which is formed on the body of the image forming apparatus, irrespective of the loading and unloading of the cassette.

17. The pickup device of claim 16, wherein said loading/unloading means comprises a supporting frame disposed on a cassette mount portion of the body; and wherein said locking/unlocking means comprises a hook member disposed on one end of the rotary shaft for selectively restricting movement of the pickup bracket according to pivoting movement of the rotary shaft.

18. An image forming apparatus, comprising:

a body;

an image forming engine portion;

a cassette detachably mounted in the body for holding a stack of paper loaded in the cassette;

pickup means for picking up a sheet of paper from the stack, and for feeding the pickup paper to the image forming engine portion; and paper remainder detecting means for detecting a remainder of the stack of paper, and for displaying detected remainder information;

wherein said pickup means comprises:

a pickup roller for feeding an uppermost sheet of paper of the stack of paper in the cassette in a predetermined direction by contacting, and thus transmitting a rotational driving force to, the uppermost sheet of paper; and a loading/unloading unit for moving the pickup roller upward and downward in association with loading and unloading of the cassette.

19. The apparatus of claim 18, wherein said pickup means further comprises:

a driving unit for transmitting the rotational driving force to the pickup roller, thereby enabling the pickup roller to feed the paper from the cassette sequentially.

20. The apparatus of claim 19, wherein said loading/unloading unit comprises:

a cam projection protruding from a leading end of the cassette;

a supporting frame disposed on a cassette mount portion of the body;

a cam lever formed on the supporting frame and elastically biased in a predetermined direction for being interfered with, and thus pivoted by, the cam projection during the loading and unloading of the cassette;

a pickup bracket disposed on the supporting frame and having a free end which moves upward and downward while rotatably supporting the pickup roller;

an elastic body for elastically biasing the free end of the pickup bracket toward the cassette; and a locking arm connected to the cam lever so as to be operated in association with the cam lever, the locking arm selectively locking and unlocking the pickup bracket.

21. The apparatus of claim 20, further comprising a main controller formed on the body, and wherein said pickup means comprises a locking/unlocking unit for selectively restricting movement of the pickup bracket so that the pickup bracket moves upward and downward by manipulation of the main controller irrespective of the loading and unloading of the cassette.

22. The apparatus of claim 21, wherein the locking/unlocking unit comprises:

a solenoid unit disposed on the supporting frame and controlled by the main controller;

a rotary shaft disposed on the supporting frame and pivoted according to operation of the solenoid unit; and a hook member disposed on one end of the rotary shaft for selectively restricting movement of the pickup bracket according to pivoting movement of the rotary shaft.

23. The apparatus of claim 20, wherein the driving unit comprises:

a driving motor disposed on the supporting frame; and a power transmitting unit for transmitting a rotational driving force from the driving motor to the pickup roller.

24. The apparatus of claim 23, wherein the power transmitting unit comprises a belt pulley disposed on the pickup bracket, and connected to an output shaft of the driving motor and to a rotary shaft of the pickup roller.

25. The apparatus of claim 23, wherein the pickup roller has a rotary shaft on which a driving gear is disposed, and wherein the power transmitting unit comprises:

a belt pulley disposed on the pickup bracket and connected to an output shaft of the driving motor; and a plurality of connecting gears disposed on the pickup bracket for connecting the driving gear disposed on the rotary shaft of the pickup roller with the belt pulley.

26. The apparatus of claim 19, wherein the paper remainder detecting means comprises:

a paper contact lever which is moved upward and downward by the loading/unloading unit to contact the stack of paper in the cassette;

a link arm which pivots in association with the paper contact lever, the link arm having a long hole formed in a body thereof;

a guide portion disposed in a parallel relation with respect to a side of the link arm, the guide portion having a guide slit overlapping a travel path of the long hole during a pivoting of the link arm;

a slide pin restrictively connected to said link arm and said guide portion by passing through the long hole and the guide slit, respectively, for linearly sliding according to the pivoting of the paper contact lever and the link arm; and a sensing unit for detecting a displacement location of the slide pin and for outputting displacement information in the form of an electric signal.

27. The apparatus of claim 26, wherein the paper remainder detecting means detects information about presence and absence of the paper in the cassette according to whether or not a free end of the paper contact lever passes through a slit formed in a bottom of the cassette.

28. The apparatus of claim 19, further comprising a main controller formed on the body; and wherein said loading/unloading unit comprises a pickup bracket having a free end which moves upward and downward while rotatably supporting the pickup roller;

said pickup means further comprising a locking/unlocking unit for selectively restricting movement of the pickup bracket so that the pickup bracket moves upward and downward by manipulation of the main controller irrespective of the loading and unloading of the cassette.

29. The apparatus of claim 28, wherein said loading/unloading unit comprises a supporting frame disposed on a cassette mount portion of the body; and wherein said locking/unlocking unit comprises a hook member disposed on one end of the rotary shaft for selectively restricting movement of the pickup bracket according to pivoting movement of the rotary shaft.

30. The apparatus of claim 19, wherein the pickup roller feeds the uppermost sheet of paper in a direction perpendicular to a direction in which the cassette is loaded and unloaded.

31. The apparatus of claim 19, wherein the driving unit comprises:

a driving motor; and a power transmitting unit for transmitting a rotational driving force from the driving motor to the pickup roller.

32. The apparatus of claim 31, wherein the power transmitting unit comprises a belt pulley disposed on the pickup bracket, and connected to an output shaft of the driving motor and to a rotary shaft of the pickup roller.

33. The apparatus of claim 31, wherein the picking roller has a rotary shaft on which a driving gear is disposed, and wherein the power transmitting unit comprises:

a belt pulley disposed on the pickup bracket and connected to an output shaft of the driving motor; and a plurality of connecting gears disposed on the pickup bracket for connecting the driving gear disposed on the rotary shaft of the pickup roller with the belt pulley.

34. An image forming apparatus comprising:

a body;

an image forming engine portion;

a cassette detachably mounted in the body for holding a stack of paper loaded in the cassette;

pickup means for picking up a sheet of paper from the stack, and for feeding the pickup paper to the image forming engine portion; and paper remainder detecting means for detecting a remainder of the stack of paper, and for displaying detected remainder information;

wherein the paper remainder detecting means comprises:

a paper contact lever which is moved upward and downward to contact the stack of paper in the cassette; and wherein the paper remainder detecting means detects information about presence and absence of the paper in the cassette according to whether or not a free end of the paper contact lever passes through a slit formed in a bottom of the cassette.

* * * * *